United States Patent [19]

Focke et al.

[11] Patent Number: 5,009,322

[45] Date of Patent: Apr. 23, 1991

[54] PROCESS AND APPARATUS FOR CHECKING/SEPARATING OUT CIGARETTES

[75] Inventors: Heinz Focke, Verden; Jürgen Süssenguth, Lilienthal, both of Fed. Rep. of Germany

[73] Assignee: Focke & Co. (GmbH & Co.), Verden, Fed. Rep. of Germany

[21] Appl. No.: 177,737

[22] Filed: Apr. 5, 1988

[51] Int. Cl.[5] ..... B07C 5/12

[52] U.S. Cl. ..... 209/536; 53/54; 53/500; 131/907

[58] Field of Search ..... 209/535, 536, 546, 548, 209/549, 586, 587; 53/53, 54, 148-151, 498-500, 504; 131/282, 283, 904, 905, 907, 908; 250/223 R

[56] References Cited

U.S. PATENT DOCUMENTS

| | | | |
|---|---|---|---|
| Re. 29,839 | 11/1978 | McLoughlin et al. | 209/536 |
| 3,729,636 | 4/1973 | Merker | 209/536 X |
| 3,980,567 | 9/1976 | Benini | 209/535 X |
| 4,090,794 | 5/1978 | Benini | 250/223 RX |
| 4,486,098 | 12/1984 | Buchegger et al. | 209/536 X |
| 4,553,847 | 11/1985 | Lang | 209/536 X |

FOREIGN PATENT DOCUMENTS

| | | |
|---|---|---|
| 0136092 | 4/1985 | European Pat. Off. . |
| 1257651 | 12/1967 | Fed. Rep. of Germany . |
| 1532268 | 11/1971 | Fed. Rep. of Germany . |
| 2332813 | 1/1974 | Fed. Rep. of Germany . |
| 2411231 | 9/1974 | Fed. Rep. of Germany . |
| 2343668 | 3/1975 | Fed. Rep. of Germany . |
| 2512640 | 9/1975 | Fed. Rep. of Germany . |
| 2434736 | 1/1976 | Fed. Rep. of Germany . |
| 2444708 | 4/1976 | Fed. Rep. of Germany . |
| 2625001 | 12/1976 | Fed. Rep. of Germany . |
| 3234330 | 4/1983 | Fed. Rep. of Germany . |
| 3146506 | 6/1983 | Fed. Rep. of Germany . |
| 3146507 | 6/1983 | Fed. Rep. of Germany . |
| 3302951 | 9/1983 | Fed. Rep. of Germany . |
| 3403485 | 8/1984 | Fed. Rep. of Germany . |
| 3441938 | 5/1986 | Fed. Rep. of Germany . |
| 3638519 | 5/1988 | Fed. Rep. of Germany . |

OTHER PUBLICATIONS

"*Selcom Messysteme*", Optocator Systembeschreibung, 1980.

*Primary Examiner*—Margaret A. Focarino
*Assistant Examiner*—Edward M. Wacyra
*Attorney, Agent, or Firm*—Sughrue, Mion, Zinn, Macpeak & Seas

[57] ABSTRACT

In the checking of cigarettes, there is the problem that, for contactless measurement, they have had to be guided at an exactly defined distance from the sensor. It is proposed to measure the distance from the two axial end faces, to form the sum of the distances or standardize the signals relative to one another, and to generate an error signal resulting in separation out when the sum of the distances is outside a predetermined threshold range set in accordance with the color of the tobacco in the cigarettes.

6 Claims, 3 Drawing Sheets

PROCESS AND APPARATUS FOR CHECKING/SEPARATING OUT CIGARETTES

BACKGROUND OF THE INVENTION

The present invention relates to an apparatus and a process for checking/separating out cigarettes.

In the packaging of cigarettes, these are guided, stacked on top of one another in a vertical shaft, to an apparatus forming blocks of cigarettes which comprise a number of cigarettes corresponding to the pack content. The shaft is therefore divided into several (for example, 7) individual shafts. To ensure that the (closed) pack does not contain a defective cigarette, that is to say one from which tobacco has fallen out during transport, the cigarettes in the assembled block are tested by mechanical sensing means and an entire block is rejected even when only one of the cigarettes is defective. This means that a whole series of intact cigarettes has to be rejected, although often only a single cigarette is defective.

In order to reduce the reject rate, it is known, for example from German Auslegeschrift 1,257,651, to test and reject individual cigarettes before these have been formed into blocks and pushed into a box. Here, the defective cigarettes are ejected from the continuous flow by being blown out. According to this publication, the error check is carried out by means of mechanical sensing. However, this mechanical sensing is relatively slow.

German Auslegeschrift 1,532,268 makes known a contactless sensing, in which the cigarettes are guided past a reflection-light barrier arrangement with their tobacco-side ends sliding on a transparent plate. After the cigarettes have been guided by means of the plate in a specific relative position as regards the light barrier arrangement, it is possible to ascertain from the output signal of the light barrier whether there is a cavity in the tobacco filling at the end or whether it is "level" with the end face. However, since such a check involves relatively small changes in the output signal from the light barrier, the cigarettes must rest exactly on the transparent surface. As soon as there is a certain distance between the surface and the cigarette end, the output signal from the light barrier changes and the cigarette is detected as defective, even though there is actually no fault. Moreover, this exact guidance on the one hand reduces the maximum possible working speed of the arrangement as a whole because of the frictional forces occurring and, on the other hand, increases the danger that the cigarettes will jam or be damaged in the (vertical) shaft, since the cigarettes have to be guided without any play.

SUMMARY OF THE INVENTION

Starting from the state of the art mentioned above, the object of the present invention is to develop a process and apparatus of the type mentioned in the introduction, in such a way that an exact check of the cigarettes becomes possible, without thereby incurring the danger of jamming.

This object is achieved because the distance from two axial end faces is measured, the sum of the distances is formed or the signals are standardized relative to one another, and an error signal resulting in the separation out of the particular cigarette is generated when the sum of the distances is outside a predetermined threshold range.

The "standardization" ensures in the simplest possible way that the cigarettes can be guided with play (in the longitudinal direction) relative to the shaft, thus eliminating the danger of jamming. On the other hand, the error signal is nevertheless formed exactly. A further surprising advantage arises "automatically" from the procedure according to the invention: both cigarette ends are checked simultaneously and the cigarette is rejected when one of the cigarette ends is defective. Both filterless cigarettes and filter cigarettes can be tested, in the latter case checking for missing filters being carried out. In general, therefore, the checking of the cigarettes is substantially "more complete" than has hitherto been possible with a single apparatus.

The physical principle by which the contactless measurement is made can be selected according to the properties of the surfaces to be checked. Thus, not only measurement by means of a reflection-light barrier, but also, for example, capacitive measuring systems or those based on ultrasonics are suitable.

In an especially preferred embodiment of the invention, an average value is formed from the sums of distances of a specific number of previous measurements, the difference between this average value and the current sum value is formed, and only then is the difference between the current sum value and the average value compared with the threshold range. Thus, slow changes, such as those which can lead to falsification of the measurement result, for example, as result of increasing dirt, where distance measurement of the light-barrier type is concerned, can be compensated, and also ageing of constructional elements, a change of colour of the tobacco or other disruptive influences are thereby reduced.

An apparatus for carrying out the process is characterized in that there are two distance-measuring sensors which are held at a specific distance from one another, in such a way that their output signals correspond to the respective distances from the respective end faces of a cigarette to the measuring sensors, and in that the circuit arrangement for processing the measuring-sensor output signals is designed in such a way that the output signals are added up or standardized relative to one another, the sum signal is compared in a comparator with a presettable threshold value, and an output signal for activating a separating-out device is emitted at the output of the circuit arrangement when the comparison value is a predetermined amount.

In this apparatus, the circuit arrangement can be designed either as an analog circuit or as a digital circuit. In the latter case, advantages arise, particularly where the formation of a sliding average is concerned, because of the simpler handling of the circuit arrangement, which can be designed, for example, as a microcomputer.

Further features essential to the invention emerge from the subclaims and from the following exemplary embodiments which are explained in detail with reference to drawings figures in which:

DETAILED DESCRIPTION OF PREFERRED EMBODIMENTS

Figure 1:
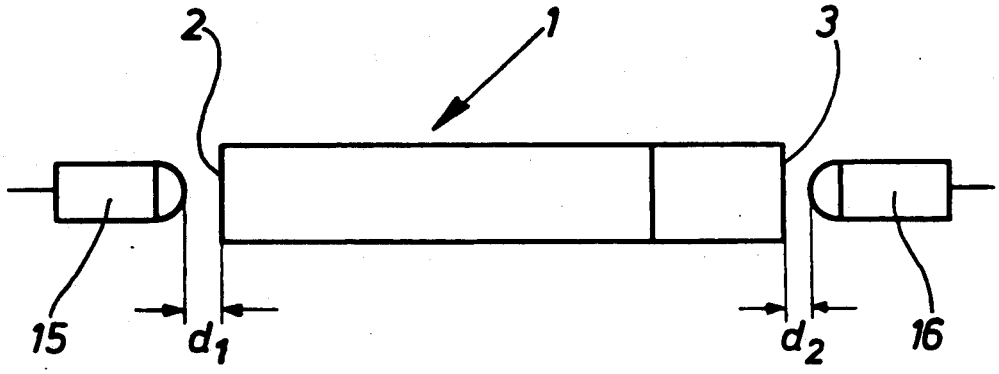
FIG. 1 shows a diagrammatic representation of a cigarette with measuring sensors arranged in relation to it.

As illustrated in FIG. 1, during the actual test operation a cigarette 1 is located between two measuring sensors 15, 16 which, in the present case, are designed as reflection-light barriers. The arrangement here is such that between one sensor 15 and the tobacco end face 2 of the cigarette 1 there is a distance $d_1$ and between the filter end face 3 and the second sensor 16 there is a distance $d_2$.

An output current, the amplitude of which depends on the respective distance $d_1$ and $d_2$ from the reflecting "measuring face", is obtainable at the light barriers 15, 16. The dependence is such that, when the distance of the measuring face 2 or 3 from the respective sensor 15 or 16 increases, the output signal decreases.

Figure 2:
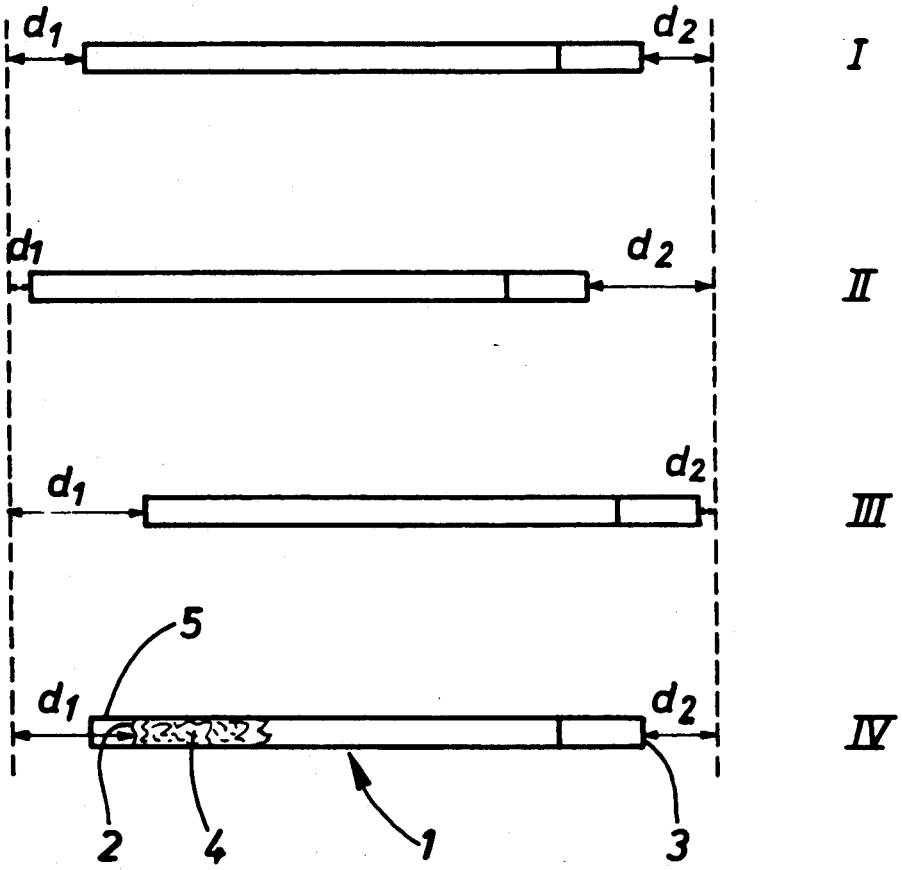
FIG. 2 shows four possible positions of cigarettes in the shaft.

FIG. 2 shows four cases designated I to IV. In case I, the distances $d_1$ and $d_2$ from the sensors are shown equal (as broken lines). In cases II and III, although the distances $d_1$ and $d_2$ differ from one another, the sums of the distances are nevertheless once again equal to the sum of the distances in case I, since constant cigarette lengths can be assumed and the light barriers 15 and 16 are mounted at a uniform distance from one another.

In case IV, the tobacco filling 4 of the cigarette 1 is incomplete, so that the tube 5 projects beyond the front end 2 of the tobacco filling 4. Now since the distance measurement takes place between the sensors and the end faces, but not the cigarette tube 5, in case IV the sum of the two distances $d_1$ and $d_2$ is greater than the sums in the preceding cases. This criterion is used to detect faults.

If it is assumed that, when the cigarette 1 is intact and is supported centrally between the reflection-light barriers 15 and 16, the distances $d_1$ and $d_2$ each correspond to a standardized value of 50%, then the two values added together make 100%. In case II, the values $d_1$ 20% and $d_2$ 80% are likewise added together to make 100%, and in case III the values $d_1$ 80% and $d_2$ 20% make 100%. In case IV, however, the value $d_1$ is 70% and the value $d_2$ is 50%, that is to say the values together make 120%. In case IV, the cigarette is therefore outside the "norm" and is therefore detected as defective.

In the foregoing, the individual distances were standardized to percentage values and the sum of the percentage values was then formed. Of course, it is also possible to represent the individual values exactly as result of calibration of the measuring sensors, so that the sum can then be formed. If it is assumed that the cigarette has a play of approximately 2 mm in the axial direction in the shaft as a whole, the sum of the distances for a correct cigarette would then be 2 mm, but greater for a defective cigarette.

It also emerges from the foregoing that it does not matter which of the two distances results in the cigarette being detected as defective. A cigarette is also detected as defective when the filter is missing or when both the filter and a certain quantity of tobacco are missing.

Figure 3:
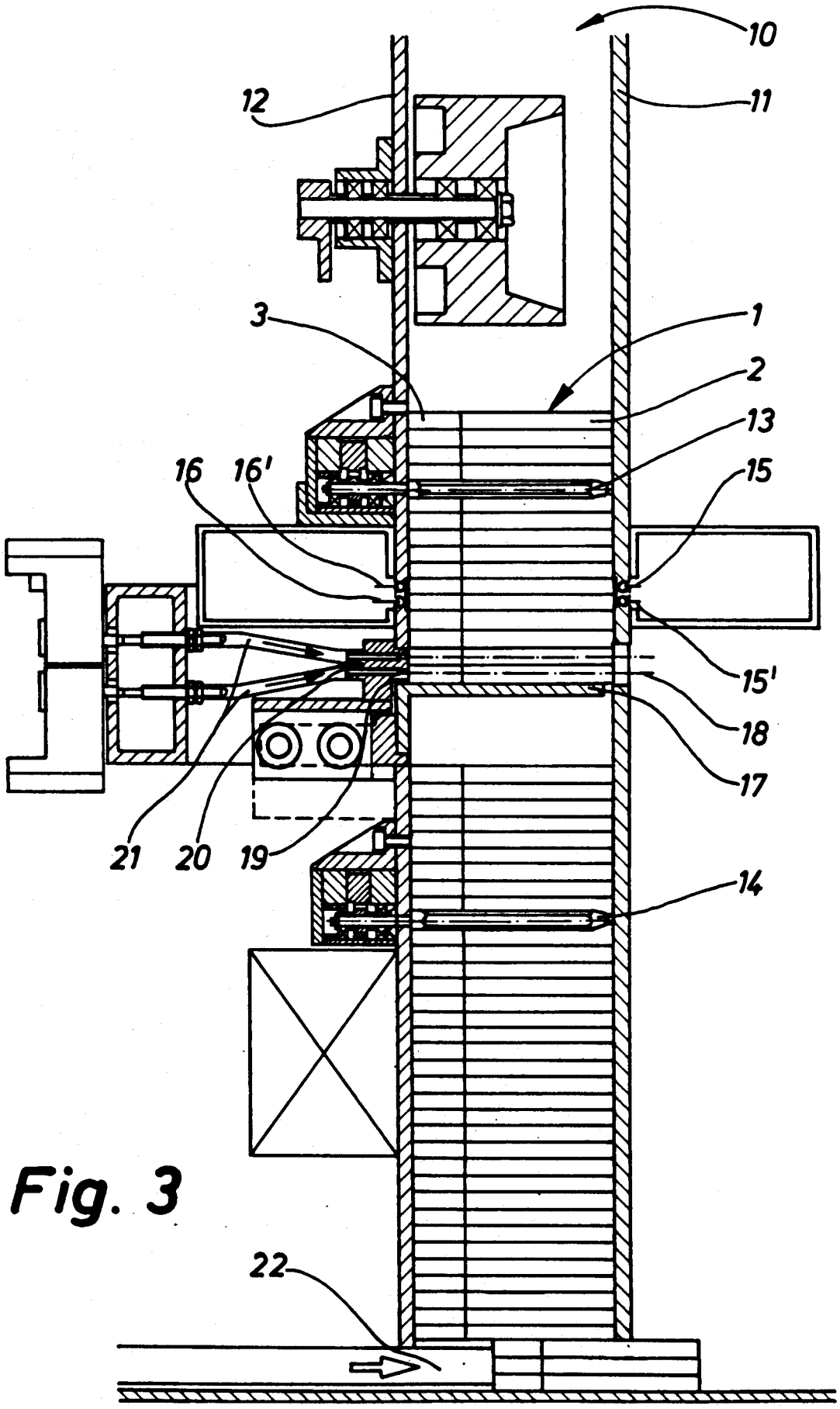
FIG. 3 shows a diagrammatic lateral section through a shaft with sensors and ejection means.

The arrangement illustrated in principle in FIG. 1 is shown in the actual apparatus in FIG. 3. It emerges from FIG. 3 that the arrangement is placed in a shaft 10, in which the cigarettes 1 are supplied at the top by feed means (not shown) and are pushed out in groups at the bottom via a pusher 22. The shaft 10 is widened in a funnel-shaped manner in the upper portion, whilst in the lower portion it extends in a straight line. The shaft walls 11 and 12 are guided parallel to one another over the entire height, and their inner faces are at a distance from one another which is greater by an amount of approximately 2 mm than the length of the cigarettes 1.

Two sensors 15, 15' and 16, 16' are arranged above one another in each of the two shaft walls 11 and 12, so that two cigarettes located above one another can be tested simultaneously. As many pairs of sensors are arranged in the "depth" direction of FIG. 3 as corresponds to the width of a pack to be filled.

Hexagonal vibrating bars 13 and 14 are provided above and below the sensors and execute a to-and-fro rotary movement in order to keep the cigarette stack in motion.

Two cigarette diameters underneath the sensors 15, 15' and 16, 16' open out two nozzle orifices 19 of nozzles 20 which are connected to a compressed-air source via compressed-air lines 21 and valves (not shown). An orifice 18 is made in the shaft wall 11 directly opposite the nozzle orifices 19. This nozzle arrangement forms, together with the orifice 18 and a supporting face 17 shiftable in the drawing plane of FIG. 3, an ejector device for cigarettes detected as defective. The supporting face 17 here is a "prong" of a rake-shaped arrangement, in which the prongs and gaps each have the width of a cigarette. Thus, during the movement of the supporting face 17 or of the rake belonging to it, the shaft can be "opened" or blocked.

The cigarettes are both checked and separated out intermittently, that is to say first a pair of cigarettes is tested, and the test result is stored and only after two strokes (corresponding to cigarette diameters) is used to activate the blowing-out nozzles 20. This separating-out operation is known per se and does not need to be described in detail here.

A further detail essential to the invention is described in detail below with reference to FIG. 4.

In the Figure, the curve of an output signal A is shown as a function of the distance $d_1$ or $d_2$, if the sensors are light barriers. In this case, the sensor output signal A depends not only on the distance from the measuring face, but also on the colour of the tobacco. With light tobacco (curve H), the output signal is larger than with very dark tobacco (curve D). Of course, if the distance from the filter is measured, the output signal is further increased substantially.

After the tobacco has been produced in batches and fed to the machine, there are often changes in the tobacco colour during the continuous packaging operation, even though these are relatively slight. In this case, therefore, the output signal A can change within the family of curves according to FIG. 4. To take this fact into account, the decision threshold (sum of the standardized distances) is set lower for dark tobaccos than for lighter tobaccos.

Figure 5:
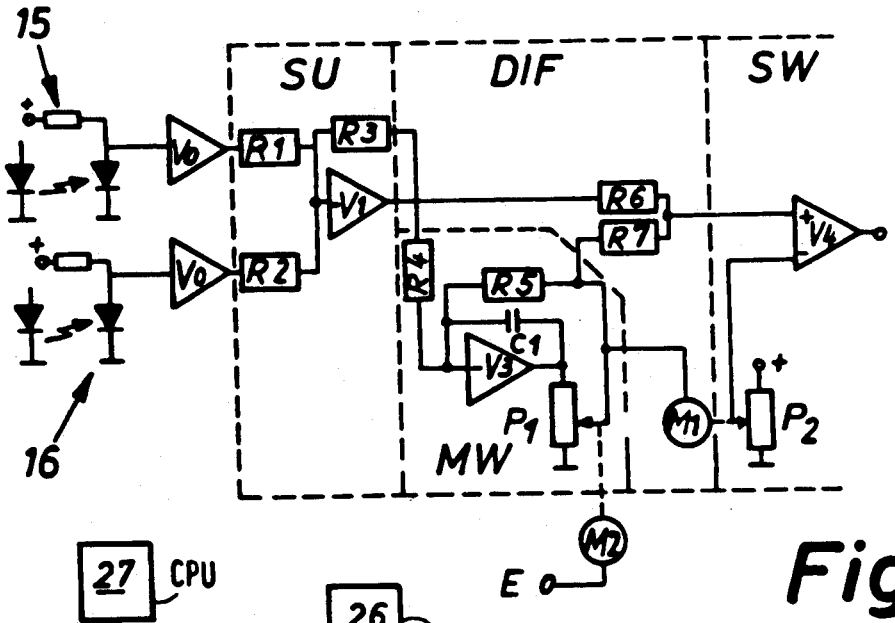
FIG. 5 shows an analog circuit for carrying out the process.

FIG. 5 illustrates an analog circuit for carrying out the process. In this analog circuit, the output signals from the sensors 15 and 16 are first summed (summer SU) after preamplification. The sum signal is fed to an average former MW which outputs an average value and which, in this particular case, is designed as an integrator with a variable time constant (adjustable by means of a potentiometer $P_1$). A difference is formed from the sum value and the average value in a subtractor DIF, the circuit shown in FIG. 5 using a summer (resistors $R_6$and $R_7$) here, since the integrator works as a reversing integrator.

The difference between the average value (output of average former MW) and the sum value is compared in a comparator circuit SW with a threshold value which is set via the potentiometer $P_2$.

Figure 4:
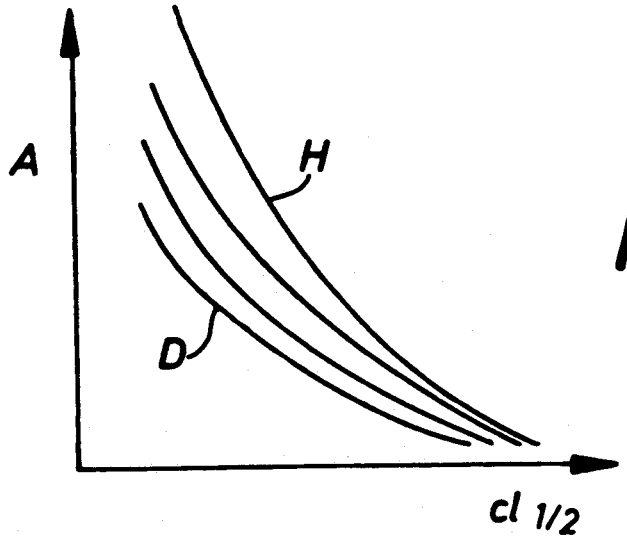
FIG. 4 shows a graph of the measurement result for different distances and tobacco colours.

To bring about the shift, shown in FIG. 4, of the threshold in relation to the tobacco colour or the mean output signal, in the circuit illustrated in FIG. 5 the potentiometer $P_2$ is set via a motor M1 which is adjusted according to the average value appearing at the juncture of resistors $R_5$ and $R_7$.

Furthermore, the integration time of the average former MW is adjusted via an input, E of a motor M2 which, here again, sets the potentiometer $P_1$ determining the integration time. The integration time is made shorter at a high stroke rate than at a low stroke rate, so that the number of measured values which determine the average value remains constant irrespective of the stroke rate. That is to say, the average value is formed in a "sliding" manner, so that each new measurement result has the same influence on the average value as the preceding measurement result.

In a further preferred embodiment of the invention, not shown in detail here, between the average former MW and the output of the summer SU there is a storage circuit (bucket brigade device) which serves to feed the sum value obtained to the integrator or average former MW only when it is certain that this sum value does not belong to a measurement with defective cigarettes. This ensures that the average value MW, in relation to which all the current values are of course "standardized", is obtained only from intact cigarettes. If this measure is not taken, it could happen that, in the event of a plurality of successive defective cigarettes, these would be accepted as intact after a certain amount of time and there would be accurate fault detection only after a (random) succession of a plurality of intact cigarettes.

Figure 6:
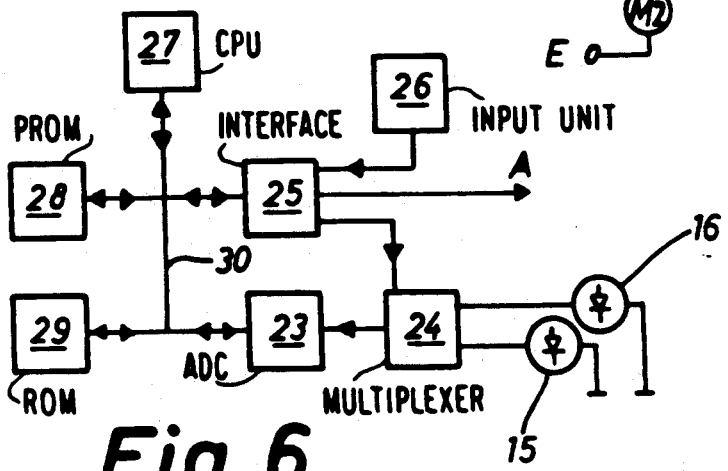
FIG. 6 shows a digital circuit for carrying out the process.

In an especially preferred embodiment of the invention, the output signals from the sensors 15 and 16 are processed in a digital circuit (computer). A circuit of this type is shown in principle in FIG. 6. The output signals from the sensor$ 15 and 16 pass via a multiplexer circuit 24 into an analog/digital converter 23 and onto a data bus 30 leading to a CPU 27. An interface 25 is connected as a digital input/output to the bus 30 in addition to a PROM 28, in which the processing program is stored, and a ROM 29 for the intermediate storage of the measurement results, the average and so on. Preset values (for example, the threshold) are entered via the interface 25 from an input unit 26 which can be operated manually. Furthermore, an output signal A for actuating the nozzles 20 and an output signal for switching the multiplexer 24 are out-putted via the interface 25. The mode of operation of the arrangement as a whole, which is determined by the program stored in the PROM 28, corresponds to the features mentioned before. In this arrangement, in particular the formation of the sliding average can be carried out especially simply and accurately.

Preferably, a "self-test" is also carried out from time to time over and above the measures described previously, and in this the absolute value of the average value is tested. If this average value is in an "unusual" range, it can be detected from this that the apparatus is malfunctioning, for example because of excessive dirt. In this case, an alarm signal and, if appropriate, at the same time an indication of the nature of the fault are emitted, so that an attendant can rectify this fault.

Of course, instead of the light-barrier measurements shown here, other contactless measurements can also be carried out. In particular, a capacitive measurement is suitable in this respect, in which case the field of characteristics shown in FIG. 4 does not represent curves for tobaccos of differing lightness, but curves for tobaccos of differing moisture contents.

Of course, the invention also extends to all the individual features listed here and to their combination.

What is claimed is:

1. Process for checking, in a contactless manner, cigarettes filled with tobacco, comprising the steps of:
   - measuring two distance values between two axial end faces of an individual cigarette and two respective reference points and producing two corresponding measuring signals;
   - obtaining a current sum value of said two distance values;
   - averaging a plurality of sum values of previous measurements for obtaining a sum average value'
   - obtaining a difference value between said sum average value and said current sum value;
   - determining a threshold value in accordance with the color of said tobacco;
   - comparing said difference value with the threshold value; and
   - generating an error signal for use in separating said individual cigarette from said cigarettes when said difference value is above the threshold value.

2. Process according to claim 1, comprising the step of forming a sliding average value while ignoring a current sum value resulting in an error signal.

3. Process according to claims 1 or 2, comprising the step of determining the threshold value as a function of the average value.

4. Process according to claim 1, comprising the step of separating out said individual cigarette in response to said error signal.

5. In an apparatus for checking cigarettes filled with tobacco and including a distance-measuring sensor, working in a contactless manner for measuring the distance from an axial end face of a cigarette to a reference point, and circuit means for evaluating output signals from the distance-measuring sensor, the improvement comprising two distance-measuring sensors (15, 16) fixed at a specific distance from one another so that output signals therefrom correspond to respective distances ($d_1$ and $d_2$) from the respective end face (2 and 3) of an individual cigarette (1) to the measuring sensors (15 and 16); and wherein (the circuit means comprises:
   - means for summing the output signals from the measuring sensors (15, 16) to produce a sum signal;
   - means for presetting a threshold value in accordance with the color of said tobacco;
   - comparing means for comparing said sum signal in a comparator with the threshold value;
   - means for generating an output signal for activating a separating-out device (17 to 21) to separate out said individual cigarette when a comparison value of said comparing means is a predetermined amount;

memory means (C1; 29) for adding up a specific number of sum signals;

subtractor means (DIF) for subtracting the content of the memory means for the sum signal before the result is fed to the comparing means for comparison with the threshold value; and adjustment means (M1, P2), connected to said memory means (C1, 29), for setting the threshold value as a function of the content of the memory means.

6. Apparatus according to claim 5, wherein the measuring sensors (15, 16) are reflection-light barriers.

* * * * *